US010066393B1

(12) United States Patent
Menendez

(10) Patent No.: US 10,066,393 B1
(45) Date of Patent: Sep. 4, 2018

(54) FIBER REINFORCED SURFACE COVERING

(75) Inventor: Mike Menendez, Redlands, CA (US)

(73) Assignee: SafetyStep TD, Redlands, CA (US)

( * ) Notice: Subject to any disclaimer, the term of this patent is extended or adjusted under 35 U.S.C. 154(b) by 0 days.

(21) Appl. No.: 12/860,769

(22) Filed: Aug. 20, 2010

Related U.S. Application Data

(60) Provisional application No. 61/236,054, filed on Aug. 21, 2009, provisional application No. 61/312,165, filed on Mar. 9, 2010.

(51) Int. Cl.
*E04C 2/02* (2006.01)

(52) U.S. Cl.
CPC ..... *E04C 2/02* (2013.01)

(58) Field of Classification Search
USPC ..... 52/3, 314, 384, 390
See application file for complete search history.

(56) References Cited

U.S. PATENT DOCUMENTS

| | | | | |
|---|---|---|---|---|
| 3,177,279 | A | 4/1965 | Bilodeau | |
| 3,426,490 | A * | 2/1969 | Taylor | 52/204.1 |
| 4,339,362 | A * | 7/1982 | Pascau | 524/5 |
| 4,349,588 | A | 9/1982 | Schiffer | |
| 4,894,272 | A * | 1/1990 | Aisley | B29C 39/026 428/119 |
| 5,447,752 | A | 9/1995 | Cobb | |
| 5,634,307 | A | 6/1997 | Larriberot et al. | |
| 5,735,094 | A | 4/1998 | Zember | |
| 5,927,034 | A | 7/1999 | Cole | |
| 5,930,964 | A | 8/1999 | Boehning | |
| 6,167,668 | B1 | 1/2001 | Fine et al. | |
| 6,237,294 | B1 * | 5/2001 | Rygiel | 52/314 |
| 6,634,617 | B2 | 10/2003 | Potvin | |
| 7,306,757 | B2 | 12/2007 | Harrington | |
| 7,735,277 | B1 | 6/2010 | Everhart et al. | |
| 2002/0098362 | A1 | 7/2002 | Mushovic | |
| 2002/0143093 | A1 | 10/2002 | Kolarik | |
| 2004/0108624 | A1 | 6/2004 | Castelli | |
| 2005/0046076 | A1 | 3/2005 | Forbes | |
| 2005/0064128 | A1 | 3/2005 | Lane et al. | |
| 2005/0188643 | A1 | 9/2005 | McGrath | |
| 2006/0083902 | A1 | 4/2006 | Jarosz et al. | |
| 2007/0157538 | A1 | 7/2007 | DeGarmo | |
| 2007/0187873 | A1 | 8/2007 | Bailey | |
| 2008/0005988 | A1 * | 1/2008 | Dombowsky | 52/314 |
| 2008/0168927 | A1 | 7/2008 | Roberts | |
| 2008/0236092 | A1 | 10/2008 | Sich | |
| 2009/0126301 | A1 | 5/2009 | Brown et al. | |
| 2009/0139160 | A1 | 6/2009 | Hill | |
| 2009/0235600 | A1 | 9/2009 | Logan et al. | |
| 2010/0005733 | A1 | 1/2010 | Anderson | |
| 2010/0005743 | A1 | 1/2010 | Anderson | |
| 2010/0005753 | A1 | 1/2010 | Anderson | |

* cited by examiner

*Primary Examiner* — Patrick J Maestri
(74) *Attorney, Agent, or Firm* — Knobbe, Martens, Olson & Bear, LLP

(57) ABSTRACT

A fiber reinforced surface covering for application to a structure, comprising at least one structural body comprising a resilient construction material with a top side and a bottom side, a flexible base coupled to the bottom side of the structural body, a spaced gap disposed between the at least one structural body and an adjacent second body, and wherein the spaced gap has a portion of the base that is substantially overlaid with the resilient construction material and configured to receive a filler material.

22 Claims, 7 Drawing Sheets

FIBER REINFORCED SURFACE COVERING

RELATED APPLICATIONS

This application claims the benefit under 35 U.S.C. § 119(e) of U.S. Provisional Patent Application No. 61/236,054, filed on Aug. 21, 2009, and entitled "FIBER REINFORCED SURFACE COVERING," and U.S. Provisional Patent Application No. 61/312,165, filed on Mar. 9, 2010, and entitled "FIBER REINFORCED SURFACE COVERING," the entire contents of both of which are hereby incorporated by reference herein and made part of this specification for all that they disclose.

BACKGROUND OF THE INVENTION

Field of the Invention

The present invention relates to surface coverings, such as floor or wall coverings and, in particular, concerns a surface covering that includes a fiber reinforced polymer cement material.

Description of the Related Art

Surface coverings are common in many applications. Floors are often covered with wood or with stone coverings for decorative purposes. Similarly, walls can also be covered with wood or stone finishes. One difficulty with natural appearing coverings is the expense of the covering and the further expense and time involved in installing the covering. In many instances, less expensive coverings are used.

One such less expensive covering is a thermal plastic covering that has designs imprinted on it to simulate more traditional coverings. For example, thermal plastic sheets that have brick patterns are often placed on floors or walls to simulate more natural types of coverings. While these thermal plastic coverings are less expensive to make and to install than more natural coverings, they often appear to be cheap, can be less durable, and are, thus, less desirable as alternatives to more natural surface coverings.

Hence, there is a need for more realistic looking surface coverings for surfaces such as walls and floors that are less expensive to manufacture and install, and are less time consuming to install than natural surface coverings like brick, rocks, stone, and the like.

SUMMARY OF THE INVENTION

In one embodiment, a fiber reinforced surface covering for application to a structure is provided, wherein the surface covering includes at least one topping material comprising a resilient polymer cement material with a top side and a bottom side, a flexible base coupled to the bottom side of the topping material, and a spaced gap disposed between the at least one topping material and an adjacent second topping material. The spaced gap has a portion of the base that is substantially overlaid with the polymer cement and is configured to receive grout material. The spaced gap and the topping material are monolithically formed, and a grout material is disposed in the spaced gap that substantially fills at least a bottom portion of the spaced gap.

In one embodiment, a fiber reinforced surface covering for application to a structure is provided, wherein the surface covering includes at least one structural body comprising a resilient construction material with a top side and a bottom side, a flexible base coupled to the bottom side of the structural body, and a spaced gap disposed between the at least one structural body and an adjacent second body. The spaced gap has a portion of the base that is substantially overlaid with the resilient construction material and configured to receive a filler material.

DETAILED DESCRIPTION OF THE PREFERRED EMBODIMENT

Figure 1:
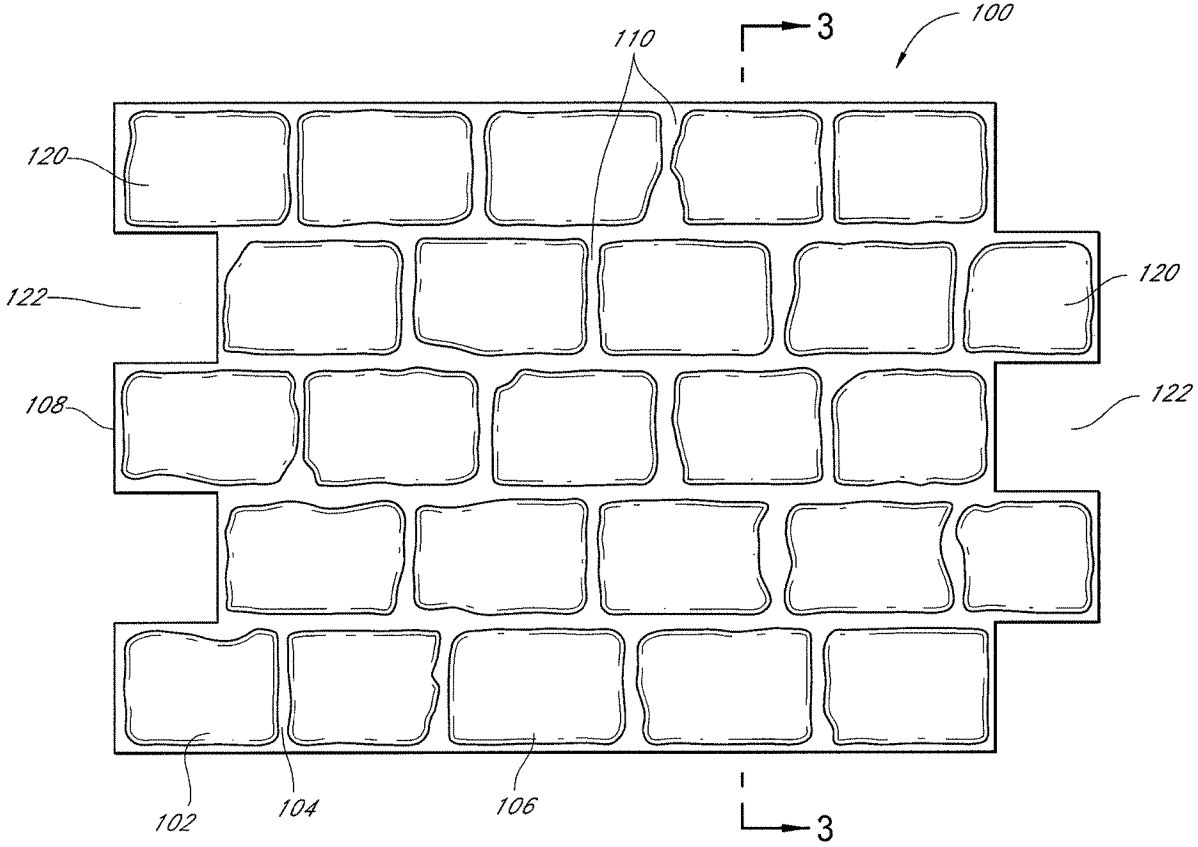
FIG. 1 is a top view of an embodiment of a fiber reinforced surface covering.
Figure 2:
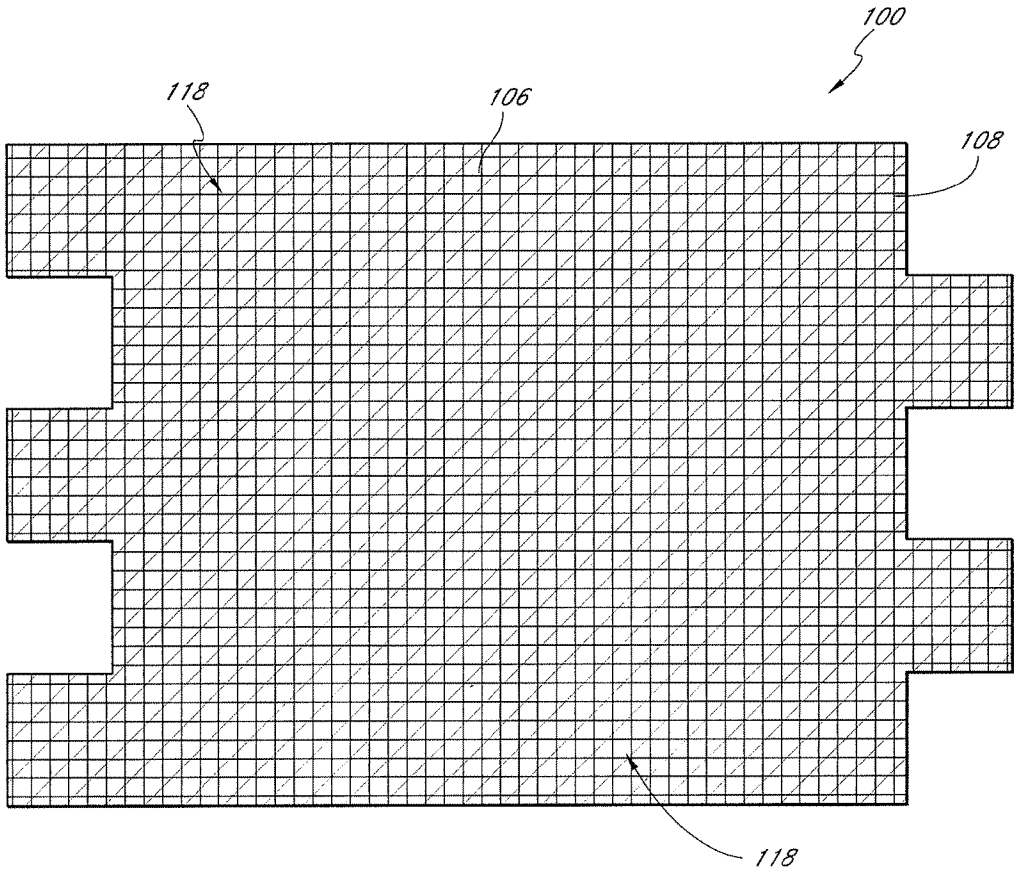
FIG. 2 is a bottom view of a fiber reinforced surface covering of FIG. 1.
Figure 3:
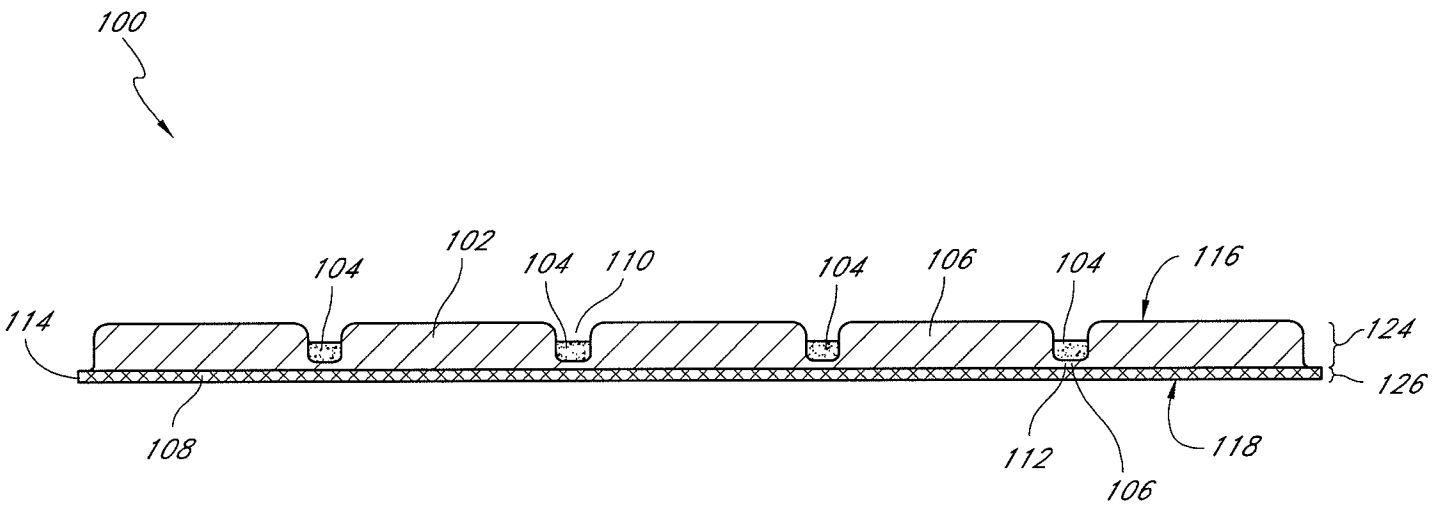
FIG. 3 is a cross-section view of the fiber reinforced surface covering of FIG. 1.

The following detailed description is now directed to certain specific embodiments of the disclosure. In this description, reference is made to the drawings wherein like parts are designated with like numerals throughout the description and the drawings.

A typical decorative covering system can include a variety of natural topping materials, or structural body materials, such as wood or masonry material. Some natural masonry materials, for example, can include a large variety of individual masonry elements such as stone, brick, or tile that are individually adhered to a wall or floor substrate using common mortar or adhesive to bond the element in place. The installation of the individual, natural material stones or bricks, for example, requires significant effort in moving and placing these heavy raw materials in desired patterns on the substrate. Such individual masonry elements are generally smaller that 18 inches square, thus a large number of masonry elements must be installed to cover the full substrate area. The masonry elements generally require cutting operations to fit the material to area being covered. These weight, quantity, and labor intensive installation process considerations for the masonry elements contributes to the high costs of installing such surface covering construction systems.

Certain embodiments described herein are directed to methods and devices to provide an improved surface covering that can have reduced installation costs and material quantity counts. The methods and devices can include a fiber reinforced surface covering. However, the methods and apparatuses may have application to other temporary or permanent building or related structures, and such additional applications are intended to form a part of this disclosure. For example, it will be appreciated that the systems, methods, and apparatuses may have application to, for example, direct connection to a wall, flooring, ceiling, and corresponding indoor or outdoor applications. In short, the embodiments and/or aspects of the surface covering, methods, and apparatuses described herein can be applied to other temporary or permanent building structures. And, while specific embodiments may be described herein with regard to particular building structure applications, it is to be understood that the embodiments described can be adapted for use in other structures, or building environments and are not limited to the application described.

In the illustrated embodiment of FIGS. 1-4, a fiber reinforced surface covering 100 is shown. The fiber reinforced surface covering 100, or panel, can include generally a top portion 124 and a bottom portion 126. The top portion 124 can include features similar to a typical individual topping material or surface finish for a flooring or a wall substrate surface. The features can replicate a surface covering made of masonry elements 102, e.g. stone, brick, marble, tile, granite, or the like. The bottom portion 126 can generally include a fiber mesh backing 108 reinforcement, or a backing material, or a fiberglass mesh backing, that provides structural support to the panel 100. In some embodiments, the panel 100 can include top surface 124 topping material features that replicate wood elements such that the topping material can include wood 102.

The illustrated embodiment can include the masonry elements, or stone 102, gaps 110 disposed between the stone 102, and an edge portion 114 disposed about the periphery of the panel 100. The top portion 124 is coupled, or bonded, or adhered, to the bottom portion 126, generally through a molding process that shapes the appearance of the replicated masonry surface covering. The top portion 124, or the stone 102 and the gaps 110, are fabricated, or molded, as a monolithic or single piece of polymer cement 106. The top portion 124 can include the layer of cement 106 that completely covers and/or fills the spaced mesh geometry of the mesh backing 108. Thus there is at least some thickness of cement 106 throughout substantially the entire panel 100. In some embodiments, the edge portions 114 can have unfilled or uncovered portions of the mesh backing 108 as described below. In some embodiments, small portions of the mesh backing 108 can be exposed at the base of the gaps 110 due to incomplete coverage by the cement 106. Preferably, the amount of cement 106 is sufficient to provide a level of rigidity to the panel 100 to facilitate installation, but also allows for flexibility in the gaps 110 to accommodate uneven surfaces, installation procedures etc. In one implementation, the Applicant has determined that polymer cement of the type disclosed herein having a thickness of between approximately 1 to 5 mm, and more preferably between approximately 1 to 2 mm or 1.5 mm achieves this desired level of rigidity and flexibility.

The panel 100 can further include, in some embodiments, a filler, or grout 104 applied in the gaps 110. The grout 104 is generally applied after the panels 100 are adhered to a substrate surface. In some embodiments, the grout 104 can be applied prior to adhering the panel 100 to the substrate. In some embodiments, the grout 104 is replicated by cement 106 during the molding process, eliminating the need for a separate application of grout 104.

A number of panels 100 can be assembled, or installed, together on an underlying substrate material such as a wall or flooring surface to fully cover the substrate area. The panel 100 illustrated in FIGS. 1-4 can include male portions 120 and female portions 122 that are configured to fit together in an interlocking end to end manner. The interlocking features can advantageously prevent excessive movement during layup and installation of the panels 100, assist in aligning the panels 100, as well as provide a realistic natural appearance of non-symmetric stone or brick shapes and sizes.

The panel 100 can include inherent flexibility that advantageously assists the installation process and increases the durability of the panel 100. The flexible panels 100 can easily be maneuvered and manipulated during the manual panel layout process on a wall or flooring substrate. The flexibility also provides some dampening "give" to the panel material that reduces the likelihood of material handling damage prior to installation on the substrate. The flexibility of the panel 100 can be associated with the gaps 110 that have a reduced material thickness. For example, in the illustrated embodiment of FIGS. 1-4, the gap 110 can extend in a substantially straight line from one end of the panel 100 to an opposing end. The panel 100 can be readily bendable along the straight line of the gap 110. Similarly, in a random stone shape panel as illustrated in FIGS. 5-8 the panel flexibility is not linear and will follow the direction of the gaps between the stones. The panel 100 is also flexible in directions that are not necessarily parallel to a reduced cross-section thickness of a gap 110. The thicker portion of the stone 102 also includes some inherent flexibility, although such flexibility is generally less than the flexibility along, or parallel to, a gap 110.

The size of the panel 100 can vary according to a suitable application and decoration of the surface covering. The panel 100 can have a coverage, or surface, area ranging between 1 square foot and 20 square feet, or more preferably between 4 square feet and 10 square feet. The panel 100 can also have a variety of thicknesses according to a suitable application. The thickness of the panel 100 can generally be greater at the stone 102 locations than the adjacent gaps 110. The gaps 110 include an overall thickness that is less than the stones 102. The thickness includes the thickness of the cement 106 and the fiberglass mesh 108. For example the stone 102, or the topping material being replicated, will generally be the thickest portion of the panel 100. The stone 102 can have a thickness ranging between 0.125 inches to 1.5 or 2.0 inches, or more preferably between 0.250 and 1.0 inches, or still more preferably between 0.300 and 0.750 inches.

The masonry elements 102 can generally have the appearance of any natural building material, e.g. stone, brick, marble, tile, granite, or the like. The stone 102 can be fabricated from a building material such as a cement 106, or more particularly a polymer cement. The polymer cement 106 can be molded and cured to take any moldable shape or appearance. As illustrated in the non-limiting embodiment of FIGS. 1-4, the cement 106 can be molded into a panel 100 that can include a plurality of natural appearing stone 102, or other masonry material elements, in a pattern generally aligned in one direction. The arrangement of the natural appearing stone can advantageously provide varying flexibility to the panel 100. In some embodiments, as illustrated in FIGS. 5-8, the stones can be randomly arranged.

The stones 102 of the panel 100 can be bonded and cured to the mesh reinforcement 108 at or about room temperature. The fiberglass mesh 108 can include a checkerboard, or square, arrangement of the mesh elements. The mesh 108 density can vary according to suitable applications for strength, flexibility, or the like. The mesh 108 can generally be filled with the cement 106 and adhered to the bottom surface of the stone 102 and gap 110 that comprise the top portion 124. In some embodiments, the mesh 108 can be slightly embedded in the bottom surface 118. Generally, the fiberglass mesh 108, or the shape thereof, can be exposed on the bottom surface 118 of the panel 100. The mesh 108 can provide a roughened, varied, and discontinuous underside surface that advantageously provides increased surface area for bonding to substrate surfaces. The exposed mesh 108 on the bottom side 118 can additionally minimize the thickness of the panel 100 because cement 106 is not required to cover both the top and bottom surfaces 116, 118. The minimized panel thickness can also reduce the quantity of material required to fabricate the panel, can make the panel lighter, and can provide the panel with additional flexibility.

The panel 100 top portion that includes the stone 102, the gap 110, the edge portion 114, and the bottom portion fiberglass mesh 108 are fabricated as a single piece. The panel 100 can be formed in a molding process with a mold having the negative shape of the suitable natural appearance of masonry elements 102, such as a plurality of bricks or a stones, and the spaced gap between each of the plurality of bricks/stones 102 where the filler, or grout 104, is generally applied.

The top surface 116 can be suitably colored to replicate a topping material such as the stone 102. The coloring material, compound, or liquid can be applied to the top surface 116 at any of a variety of steps during the fabrication or installation process, e.g. mixed into the uncured cement 106, applied to a surface of the negative mold prior to injecting the cement 106 into the mold, applying the coloring to the top surface 116 after removal of the panel 100 from the negative mold, or the like. The coloring of the topping material, or stone 102, can be applied to the gap 110 to simplify the coloring process. The gap 110 can subsequently be covered with the grout 104.

The panel 100 can include the gap 110 adjacent each stone 102. The gap 110 can be configured to receive the grout 104. The gaps 110 space apart the stone or bricks 102. The gap 110 forms a relief depth on the panel top surface 110. The gap 110 top surface is fabricated from the polymer cement 106 that is bonded to the underlying reinforcement material, or fiberglass mesh 108 on the bottom surface. The gap 110 can be contiguous, or formed or molded as a single piece, with the stones or bricks 102 during the molding process of the panel 100. The gap 110 can be configured with a variety of suitable width and depth dimensions. The gap 110 can have a width ranging between 1/16 inch to 1 inch, or more preferably a width between 1/8 inch to 1/2 inch, or approximately 1/4 inch. The depth of the gap 110, or the height from the top surface of the gap to the top surface of the stone 102 can range between 1/16 inch to 2 inches, or more preferably a depth between 1/8 inch to 3/4 inch, or approximately 1/4 inch. In some embodiments, the gap can have little to no depth, and can be distinguished from the stone or bricks 102 by a different surface finish, color, shape, or the like. The gap can have any shape or appearance, which is generally determined by the shape or appearance of the adjacent stones 102.

The grout 104 can be any common flooring or wall tile type grout. The grout 104 can be installed after the panel 100 is installed, or adhered, to the installation substrate. In some embodiments, the grout 104 does not need to be applied where grout can be replicated by the cement 106 in the molded panel 100. The grout 104 can have varying thicknesses suitable to the configuration and geometry of the top surface 116 of the panel 100. For example, the grout can be applied to establish a grout top surface that is substantially flush, or on the same plane, as the stone 102 top surface. Alternatively, the grout 104 top surface can be recessed below the stone 102 top surface, for example within a range between 0.025 to 0.300 inches, or more preferably between 0.075 to 0.150.

With continued reference to FIGS. 1-4, the edge portion 114 can extend all around the periphery edges of the panel 100. The edge 114 is approximately 1/2 of the width of the gap 110. The edge 114 can include the mesh backing 108 and cement 106. The cement 106 generally fills or substantially fills the openings in the mesh backing 108 of the edge portion 114; however, bare or unfilled portions of the mesh can remain in the edge portion 114. The edges 114 are configured to fit together, or abut, to adjacent edge portions 114 of adjacent panels 100 during installation on a substrate area. The edges 114 can then be covered or filled with grout 104 to cover, or hide, the panel to panel seams and give the surface covering installation a natural stone and grout appearance.

In some embodiments, the grout 104 is replicated with the polymer cement 106 during the fabrication molding process, eliminating the need for grout application after the panel 100 is adhered to the substrate. When grout is replicated by cement 106 the edge portions can be butted against one another. The abutting surfaces of the replicated grout edges of the panel 100 can have a variety of angles to obtain a clean natural appearance, e.g. 135 degrees, 90 degrees, 45 degrees, 30 degrees, or the like.

The reinforcement mesh backing 108 can include a checkerboard type layout made of fiberglass material. In some embodiments, the mesh layout can have any geometry, e.g. polygonal, square, rectangular, curved, woven, or the like. The mesh backing 108 can include a spaced distance between the individual elements of the mesh material. The spaced distance provides an area, or volume, within the thickness of the mesh backing 108 that can receive and be filled with the polymer cement 106. The mesh backing 108 can be securely adhered to the top portion 124 during the molding process when the cement 106 fills the open volume areas within the mesh 108. The mesh backing 108 can have a thickness ranging between 0.001 to 0.125 inches, or more preferably between 0.002 to 0.060 inches. The spaced distance between mesh elements can range between 0.001 to 0.125 inches, or more preferably between 0.002 to 0.060 inches. It will be appreciated that larger rocks or features may require larger mesh sizes and that the scope of the present invention should not be limited to the foregoing dimensions for the mesh, or even the dimensions for the features on the panel 100.

Figure 4:
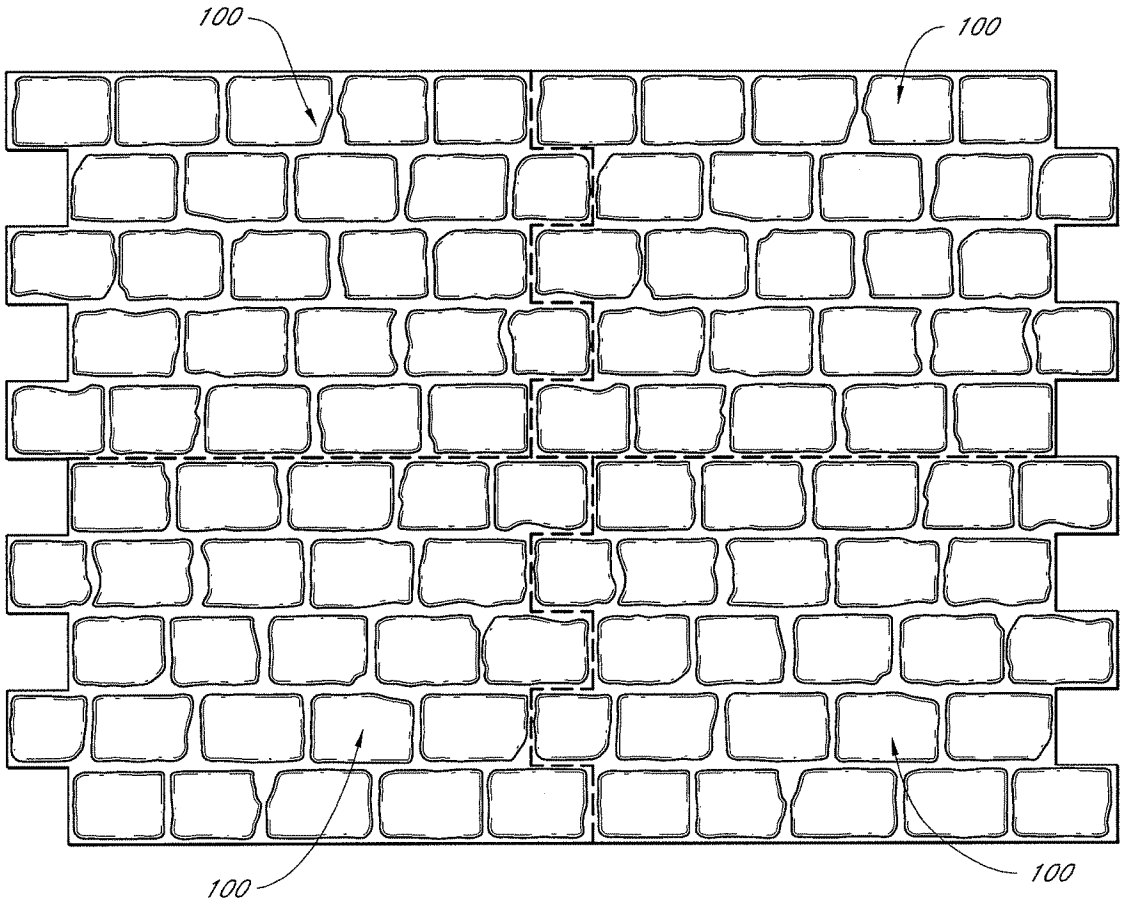
FIG. 4 is a top view of a plurality of the fiber reinforced surface covering of FIG. 1 joined together.
Figure 6:
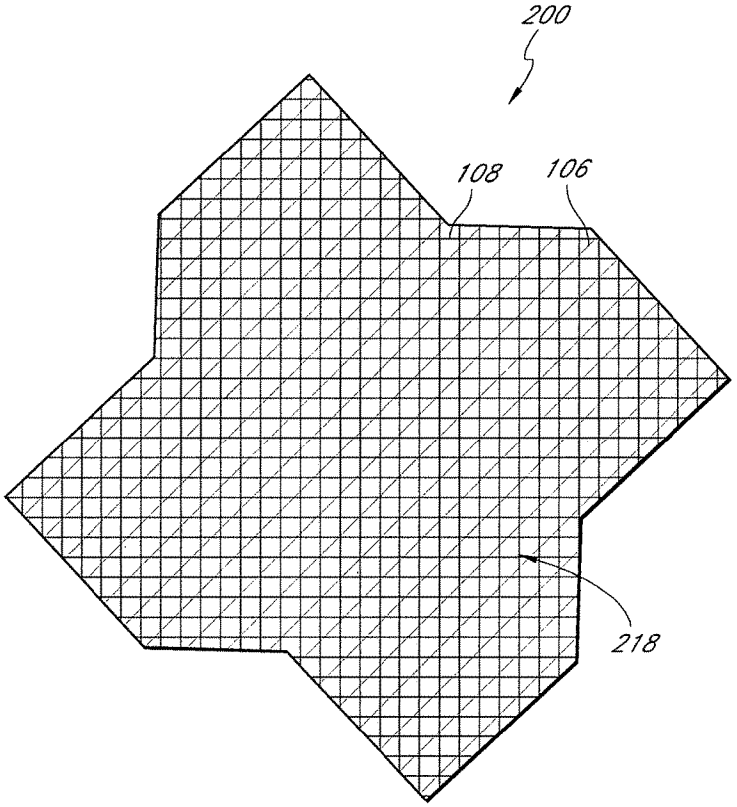
FIG. 6 is a bottom view of a fiber reinforced surface covering of FIG. 5.
Figure 5:
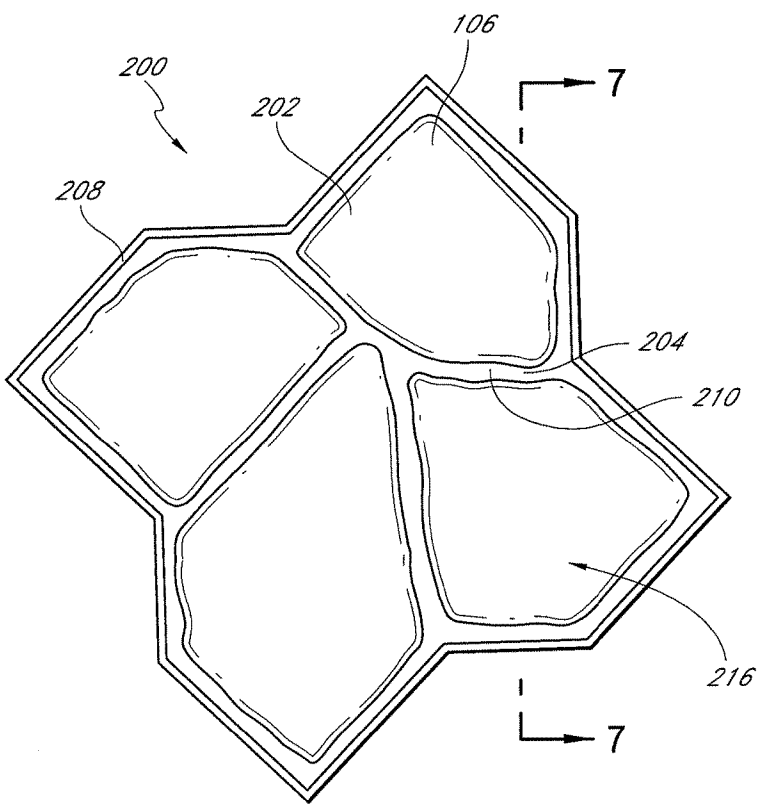
FIG. 5 is a top view of another embodiment of a fiber reinforced surface covering.
Figure 7:
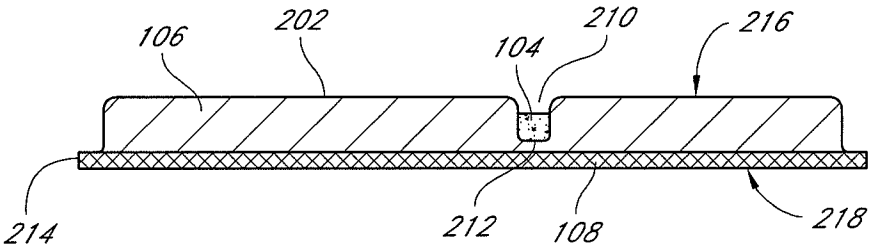
FIG. 7 is a cross-section view of the fiber reinforced surface covering of FIG. 5.
Figure 8:
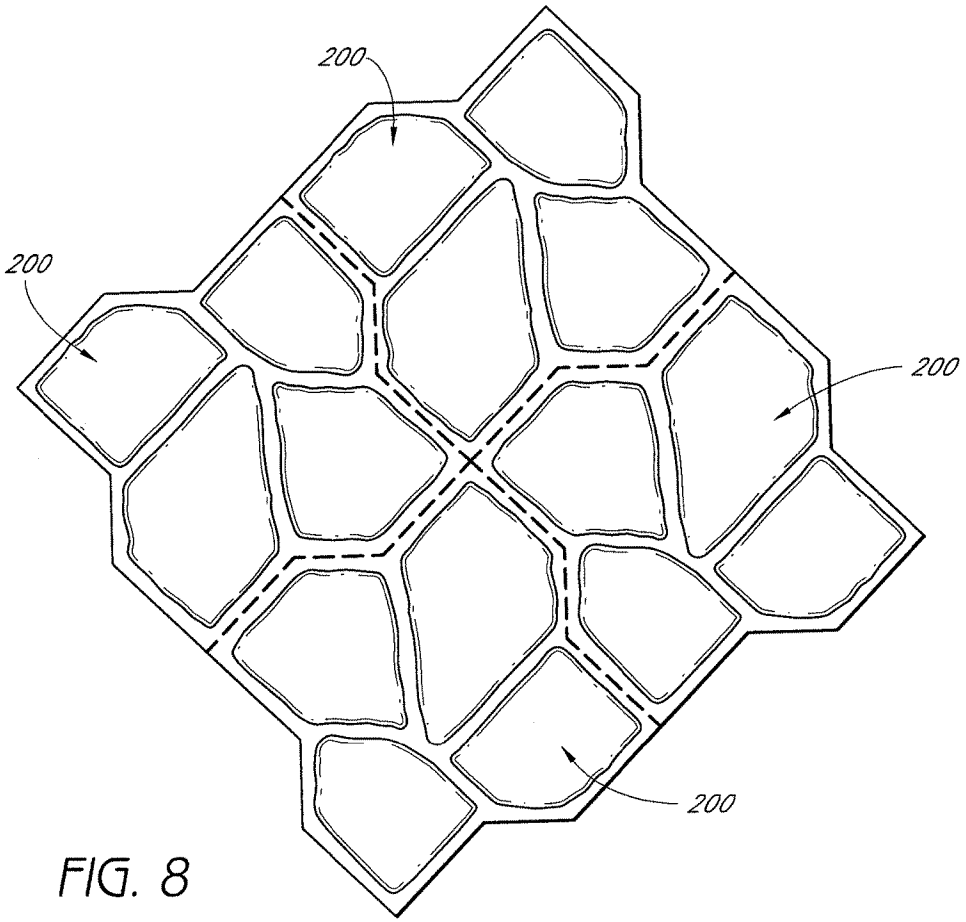
FIG. 8 is a top view of a plurality of the fiber reinforced surface covering of FIG. 5 joined together.

As illustrated in the embodiment shown in FIG. 4, the panels 100 can provide for an easy and readily installed covering system, such as a decorative wall or flooring construction that advantageously reduces the amount of raw materials, installation time, and costs to install an aesthetically pleasing and durable wall or floor system. The panels can quickly be laid out on the floor or wall substrate to determine the fit of the panels. The adjacent panels' plurality of male protruding portions 120 and female receiving portions 122 can be fittingly interlocked when a plurality of panels 100 are pieced together. Each panel 100 includes several rows of stone 102, five in the illustrated embodiment of FIGS. 1-4, thereby reducing the quantity of materials on site and the number of individual material pieces that are installed. The edge portions 114 are identified by the dashed line through the fitted panels 100. The edges 114 can be covered by the grout 104 to cover the pattern seams and further give the surface covering installation a natural and realistic appearance.

The panels 100 can be adhered to the surface substrate with common adhesives, mortars, or the like; for example, an acrylic adhesive such as SSTD-589 provided by Safety Step TD, Inc. The bottom surface 118 includes the contour of the mesh backing 108 geometry filled with the cement 106, and provides a rough, discontinuous surface that can readily adhere to the adhesive or mortar material. The polymer cement 106 can be readily cut, or trimmed, to fit the edges of the area being covered by the panels 100. The cement 106 and mesh 108 composite materials advantageously do not require the heavy duty cutting equipment that is typically required to cut masonry materials such as stone or brick.

Further advantages of installing the panel 100 include reduced amount of time to cover a surface area because of the larger size of the panels 100, the light weight of the panels, the ease of cutting the panel cement 106 and mesh backing 108 to trim the panel to size, and the reduced number of raw materials required.

The panel 100 can be molded to form the natural shape and appearance of the top surface 116 and to bond the top portion 124 to the mesh backing 108. In some embodiments, a negative mold (not shown) can be shaped to replicate any type of topping material, e.g. wood, masonry, or the like. The mold can be positioned horizontally and filled with an uncured liquid form of the polymer concrete 106. In some embodiments, other forms and orientations of a mold can be implemented, e.g. a positive mold, angled position, or the like. The polymer concrete 106 can be any common concrete; for example, a combination of SSTD-880 AD-mix and SSTD-22 Cement, both provided by Safety Step TD, Inc. The mesh backing 108 can be placed on top of the concrete 106 such that the concrete fills the volume gaps within the mesh material. The mesh backing 108 geometry generally remains visible and/or exposed on the bottom surface 118. In some embodiments, portions of the mesh backing can be covered with a thin layer of concrete 106. In some embodiments, the mesh backing 108 can be embedded in the concrete 106. The concrete 106 can cure at room temperature to a solid flexible material.

In the illustrated embodiment of FIGS. 5-8, a second configuration of a surface covering, or panel 200, is shown. The panel 200 provides stone 202 that can replicate a random natural stone shape to provide an alternative realistic decorative appearance of the installed area surface covering. The features of panel 200 are similar to the features described in detail above with respect to FIGS. 1-4. The panel 200 can include a top portion 224 and a bottom portion 226. The top portion can include natural appearing replicated stone 202, a gap 210, and an edge portion 214 fabricated from the polymer cement 106. The panels 200 can be laid out, or fitted together, in a puzzle-like manner on the area to be covered with panels 200. The edge portions 214 are abutted to one another and the panels 200 can be adhered to the substrate surface. As described in detail above, the grout 104 can fill the gaps 210 and cover the seams where the edge portions 214 abut one another.

While certain embodiments of the inventions have been described, these embodiments have been presented by way of example only, and are not intended to limit the scope of the inventions. Indeed, the novel embodiments and systems described herein may be embodied in a variety of other forms. For example, the embodiments disclosed above can be used with other forms of temporary support or accessway structures. In addition, while a number of variations of the invention have been shown and described in detail, other modifications, which are within the scope of this invention, will be readily apparent to those of skill in the art based upon this disclosure. Furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A fiber reinforced surface covering for application to a structure, comprising:

at least one topping material comprising a resilient polymer cement material with a top side and a bottom side;

a flexible base having a first and second side coupled to the bottom side of the topping material on the first side;

a spaced gap disposed between the at least one topping material and an adjacent second topping material, wherein the spaced gap has a portion of the base that is substantially overlaid with the polymer cement that forms the topping layer and configured to receive grout material, the spaced gap and the topping material monolithically formed wherein the polymer cement of the first and second topping materials is approximately 0.3 to 0.750 inches tall and wherein the polymer cement in the gap is approximately 1 to 2 mm; and a grout material disposed in the spaced gap wherein the grout material is formed of a material different than the polymer cement so that the spaced gap is filed by a bottom layer of polymer cement that is covered by the grout material wherein the grout material is recessed from the upper surface of the at least one topping material and adjacent second topping material by 0.025 inches to 0.300 inches.

2. The fiber reinforced surface covering of claim 1, wherein the fiber reinforced surface has a first level of rigidity in a first direction along the panel at the location of the first gap, and a second level of rigidity in a second direction along the panel at the location of the first gap, the first level of rigidity being less than the second level rigidity.

3. The fiber reinforced surface covering of claim 2, wherein the first direction is substantially parallel to a direction of the panel having a spaced gap that extends the full length of the panel.

4. The fiber reinforced surface covering of claim 2, wherein the first direction is substantially parallel to a spaced gap portion of the panel.

5. The fiber reinforced surface covering of claim 2, wherein the second level rigidity provides flexibility in substantially the second direction.

6. The fiber reinforced surface covering of claim 2, wherein the second direction is substantially normal to the first direction.

7. The fiber reinforced surface covering of claim 1, further comprising a natural color outer layer applied to a top side of panel, wherein the panel top side includes the topping material and the spaced gap having the polymer cement overlay, and the flexible base substantially filled with the polymer cement.

8. The fiber reinforced surface covering of claim 7, wherein the polymer cement material is the natural color substantially throughout the volume of the panel.

9. The fiber reinforced surface covering of claim 1, further comprising a geometric outer periphery configured to engage an outer periphery of at least one panel.

10. The fiber reinforced surface covering of claim 1, wherein the base comprising a polymer backing having flexible bending characteristics.

11. The fiber reinforced surface covering of claim 1, wherein the topping material is formed into the shape of a construction material consisting of one of a rock, stone, tile, wood or brick.

12. The fiber reinforced surface covering of claim 1, wherein the panel is coupled to a flooring substrate by an adhesive.

13. A fiber reinforced surface covering for application to a structure, comprising:

at least one structural body comprising a resilient construction material with a top side and a bottom side;

a flexible base having a first and a second side coupled to the bottom side of the structural body on the first side;

a spaced gap disposed between the at least one structural body and an adjacent second body wherein the first and second body are comprised of polymer cement; and wherein the spaced gap has a portion of the base that is substantially overlaid with the resilient construction material that forms the at least one structural body and configured to receive a filler material wherein the polymer cement of the first and second structural body is approximately 0.3 to 0.750 inches tall and wherein the polymer cement in the spaced gap is approximately 1 to 2 mm and wherein the filler material is different than the polymer cement so that the spaced gap is filed by a bottom layer of polymer cement that is covered by the filler material wherein the filling material is recessed from the upper surface of the at least one structural body and adjacent second body by 0.025 inches to 0.300 inches.

14. The fiber reinforced surface covering of claim 13, wherein the fiber reinforced surface has a first rigidity at the location of the spaced gap in a first direction along the panel, and a second rigidity at the location of the spaced gap in a second direction along the panel, the first rigidity being less than the second rigidity.

15. The fiber reinforced surface covering of claim 14, wherein the first direction is substantially parallel to a direction of the panel having a spaced gap that extends the full length of the panel.

16. The fiber reinforced surface covering of claim 14, wherein the first direction is substantially parallel to a spaced gap portion of the panel.

17. The fiber reinforced surface covering of claim 13, further comprising a natural color outer layer applied to a top side of panel, wherein the panel top side includes the structural body and the spaced gap having the resilient material overlay.

18. The fiber reinforced surface covering of claim 17, wherein the resilient construction material is the natural color substantially throughout the volume of the panel.

19. The fiber reinforced surface covering of claim 13, wherein the base comprising a polymer backing having flexible bending characteristics.

20. The fiber reinforced surface covering of claim 13, wherein the structural body is formed into the shape of a masonry material consisting of one of a rock, stone, or brick.

21. The fiber reinforced surface covering of claim 13, wherein the panel is coupled to a flooring substrate by an adhesive.

22. The fiber reinforced surface covering of claim 13, wherein the filler is a grout material disposed in the spaced gap.

* * * * *